US006659325B2

(12) United States Patent
Schalbetter et al.

(10) Patent No.: US 6,659,325 B2
(45) Date of Patent: Dec. 9, 2003

(54) SETTING TOOL

(75) Inventors: Dionys Schalbetter, Haag (CH); Johann Büchel, Sevelen (CH)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/081,783

(22) Filed: Feb. 21, 2002

(65) Prior Publication Data

US 2002/0113111 A1 Aug. 22, 2002

(30) Foreign Application Priority Data

Feb. 19, 2001 (DE) ..... 101 07 979

(51) Int. Cl.[7] ..... B25C 1/10
(52) U.S. Cl. ..... 227/10; 227/150
(58) Field of Search ..... 227/10, 15, 38, 227/43, 52, 150

(56) References Cited

U.S. PATENT DOCUMENTS 4,655,380 A * 4/1987 Haytayan ..... 227/9
4,883,211 A * 11/1989 Philipp et al. ..... 227/9
5,114,064 A * 5/1992 Jochum et al. ..... 227/9
5,653,370 A * 8/1997 Bereiter et al. ..... 227/10
5,884,828 A * 3/1999 Hirtl et al. ..... 227/10
5,992,723 A * 11/1999 Lee ..... 227/9
6,039,229 A * 3/2000 Pfister et al. ..... 227/10

* cited by examiner

*Primary Examiner*—Scott A. Smith
*Assistant Examiner*—Nathaniel Chukwurah
(74) *Attorney, Agent, or Firm*—Sidley Austin Brown & Wood, LLP

(57) ABSTRACT

The setting tool comprises a housing (1), a firing device (2) and an axially displaceable piston guide (3). The simple assembly of the piston guide (3) in the housing (1) is made possible by a centering means acting between the piston guide (3) and the housing. Guidance elements (14, 22), by means of the centering means, are eccentrically arranged on at least one of the piston guide (3) and the firing device (2) and extend essentially parallel to the setting direction. The guidance elements (14, 22) are coaxially disposable on at least one of the piston guide (3) and the firing device (2) relative to corresponding receiving openings (23) on the piston guide (3) and the firing device (2).

11 Claims, 3 Drawing Sheets

SETTING TOOL

BACKGROUND OF THE INVENTION

The invention relates to a setting tool comprising a housing, a firing device arranged inside the housing, a piston guide axially displaceable in the housing with a cartridge magazine and an axially displaceable driving piston, and at least one guidance element cooperating with the firing device. Centering means act between the piston guide and the housing, and guidance elements, by means of the centering means, are arranged on at least one of the piston guide and the firing device and are coaxially disposable relative to corresponding receiving openings on at least one of the piston guide and the firing device.

In explosive powder operated setting tools, the piston guide can be disassembled and removed, in the setting direction, from the rest of the setting tool for maintenance and service purposes.

At assembly, the piston guide must have a certain position relative to the firing device so that a trigger element, for example, a contact pin, which projects from the piston guide, in the setting direction, can pass through an opening into the ignition device to cooperate with the ignition device. Similarly, an alternate trigger element, such as an axially displaceable control pin for the power regulation device, projects from the stop surface of the ignition device to cooperate with a corresponding opening in the opposing surface of the piston guide.

The requisite disposition of the piston guide opposite the ignition device or the trigger elements opposite the access openings is done visually and requires that the user be familiar with the tool. Moreover, the user must align the piston guide opposite the ignition device prior to installing the piston guide in the housing.

SUMMARY OF THE INVENTION

The object of the invention is to provide a setting tool in which the piston guide can be aligned opposite the ignition device quickly, reliably and properly without requiring the user to visually align both parts.

This object is achieved by the setting tool of the present invention. The setting tool comprises a housing, a firing device arranged inside the housing, a piston guide axially displaceable in the housing with a cartridge magazine and an axially displaceable driving piston, and at least one guidance element cooperating with the firing device, wherein centering means act between the piston guide and the housing. Guidance elements, by means of the centering means, are arranged on at least one of the piston guide and the firing device and extend essentially parallel to the setting direction and are coaxially disposable on at least one of the piston guide and the firing device relative to corresponding receiving openings on at least one of the piston guide and the firing device.

The assembly of the piston guide in the housing of the setting tool and the very quick, simple and reliable alignment of the piston guide relative to the ignition device is possible because of the centering means of the setting tool of the invention.

Preferably, economical and easy-to-manufacture centering means comprise at least one centering lug and at least one guide groove a centering means, wherein the centering lug is disposed on the piston guide or on the housing and the guide groove is disposed on the piston guide or on the housing. The length of the centering lug extending parallel to the setting direction can be fashioned very short or can have the form of a rib with a greater length.

For manufacturing process reasons, the centering lug is preferably part of a centering ring encompassing the piston guide and cooperates, in a non-rotational manner, with the piston guide. The ring is simple to manufacture and easily connected to the piston guide.

The centering ring is displaceable, in the setting direction, against the force of a spring element such that the length of the guide groove can be kept short.

A rotational key of the centering ring is provides a rotationally resistant connection of the centering ring along the piston guide. The rotational drive projects into the inside space of the centering ring. The centering ring projects into a rotational key way and is arranged on the piston guide, extending parallel to the setting direction. The key way is, for example, a projection of the centering ring that extends into the inside space of the centering ring.

A space between an opening of the guide groove, on the setting side, and a stop surface of the firing device, facing in the setting direction, is greater than a maximum space between the centering lug and the free end of an initial trigger or guidance element facing away from the setting direction. Additionally, the space can be greater than the sum of the space formed by the space between the centering lung and the opposing surface of the piston guide and the space between the stop surface of the firing device and the setting-side end of a second control or trigger element. This space is provided to make it possible for the piston guide, when inserted into the housing, to be rotated relative to the firing device for the peripheral mutual alignment, without a control or trigger element preventing the rotation. Preferably, this rotation occurs with the setting tool in an unassembled state.

Preferably, at least one part of the guide groove is a centering sleeve open on the setting-side that is fixed, in a receiving space of the housing, to prevent damage to the receiving bore of the housing.

Preferably, the trigger or guidance element projecting from the piston guide is a contact pin that cooperates with the firing device. The trigger element projecting from the firing device is formed by an axially displaceable control pin of a power regulating device.

Other features and advantages of the present invention will become apparent from the following description of the invention which refers to the accompanying drawings.

BRIEF DESCRIPTION OF THE INVENTION

DETAILED DESCRIPTION OF THE INVENTION

Figure 1:
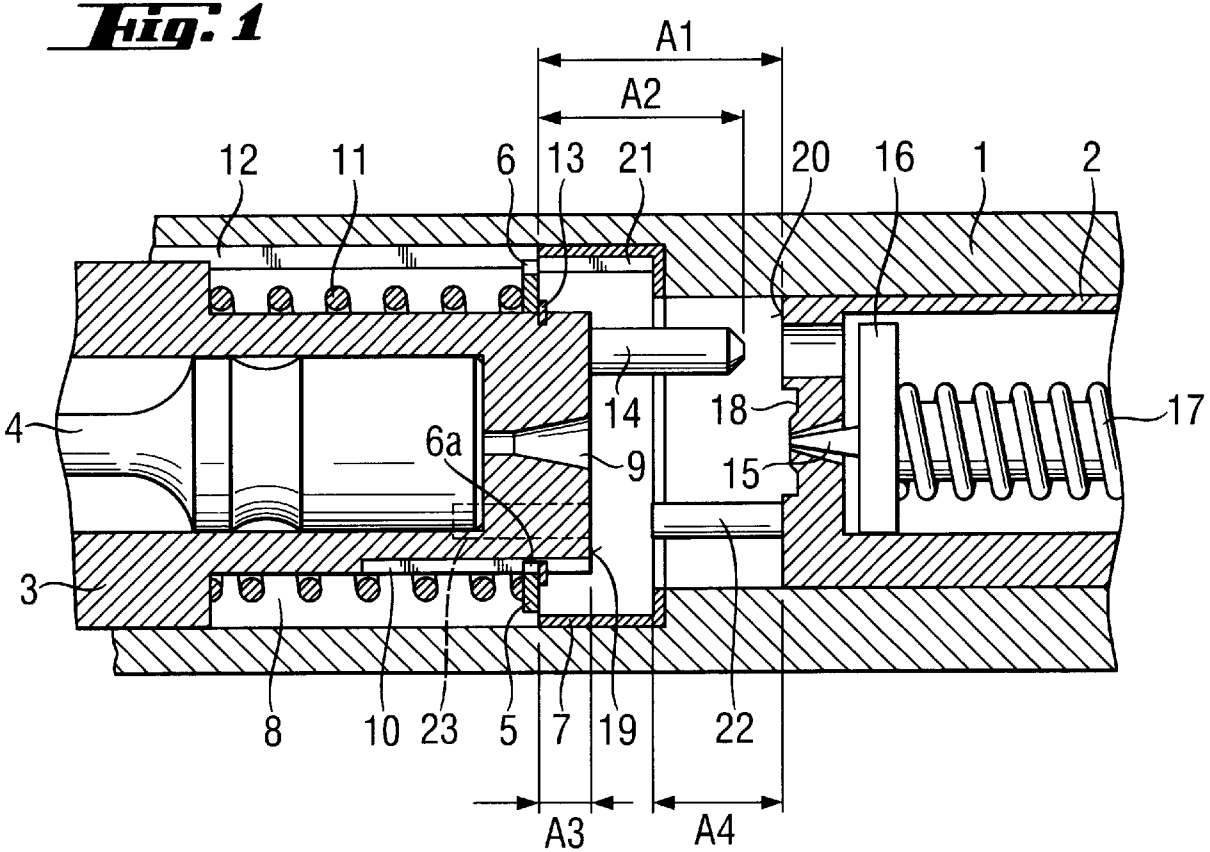
FIG. 1 illustrates a cut-away section of a setting tool, during assembly, wherein the piston guide is aligned relative to the firing device by a centering lug and a guide groove, in accordance with the invention.
Figure 2:
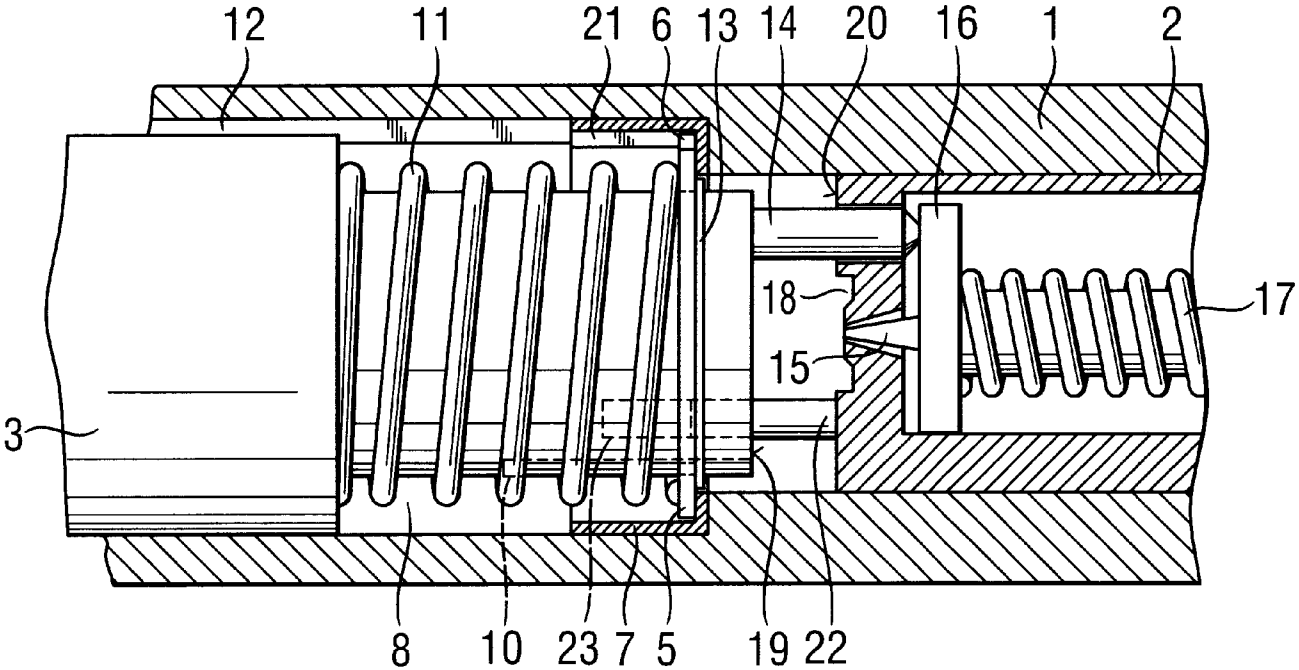
FIG. 2 illustrates the setting tool of FIG. 1 in an assembled condition, wherein the setting tool is in the starting position, in accordance with the invention.
Figure 3:
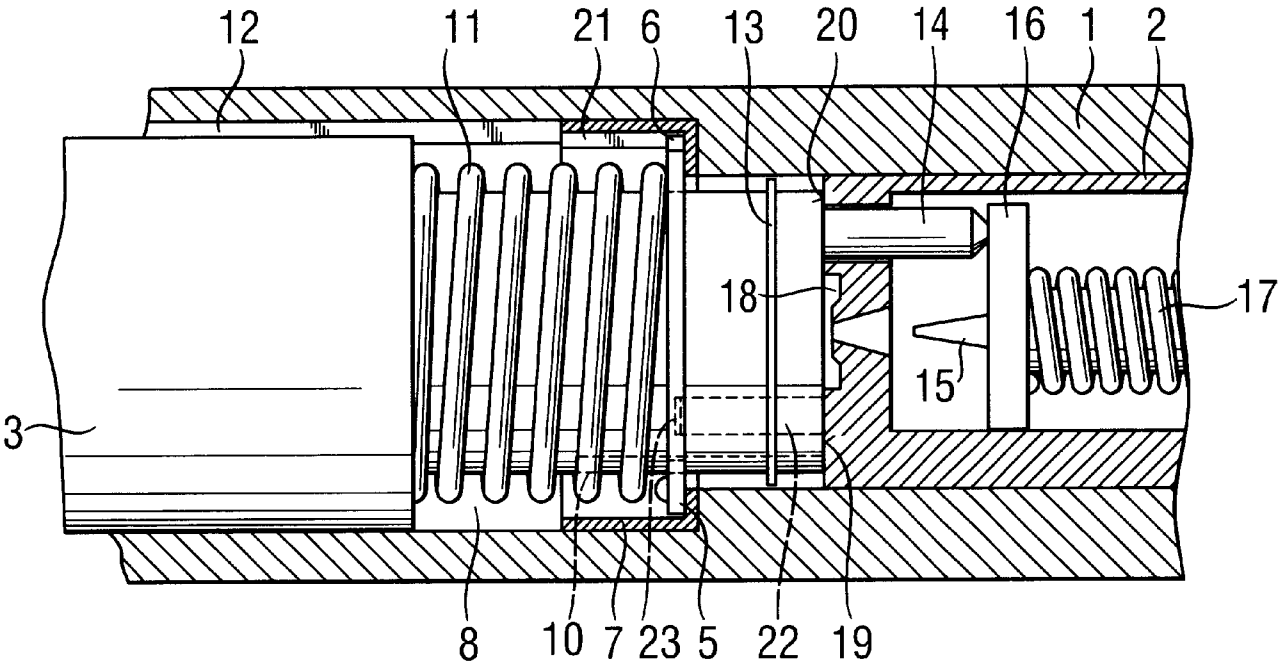
FIG. 3 illustrates the setting tool of FIG. 1, in a firing position, in accordance with the invention.

The setting tool, in accordance with the invention, as illustrated in FIGS. 1 to 3, comprises a housing 1, a handle with an actuator switch (not shown in the illustration), a bolt guide on the setting side (also not shown), a piston guide 3 arranged inside the housing 1, and an axially displaceable firing device 2.

The piston guide 3 is displaceable in the housing 1, in the setting direction, against the force of a spring (not shown). A cartridge magazine 9, from an opposing surface 19 of the piston guide 3 facing away from the setting direction, extends in the setting direction and opens into a connecting passage. The connecting passage extends to a guide bore, wherein an axially displaceable driving piston 4 is arranged.

A receiving opening 23, from the opposing surface 19, extends in the setting direction. The opening receives a rod-shaped guidance element 22. The guidance element 22 is, for example, an axially displaceable control pin of a power regulation device. The external contour of the piston guide 3 tapers stepwise away from the setting direction. A centering ring 5 encircles the external contour of the piston guide 3, in an end zone of the stepwise tapering facing away from the setting. The centering ring 5 is displaceable, opposite the setting direction, against the force of a spring element 11 relative to the piston guide 3. The spring element 11 rests, in the setting direction, on an annular surface of the piston guide 3 facing away from the setting-end, which is arranged in the area of the diameter increase.

Opposite the setting direction, the guide ring 5 is supported by a radial spring-biased retaining ring 13 that partially extends into a peripherally fashioned groove in the piston guide 3. The piston guide 3 comprises a rotary guide groove 10, which runs parallel to the setting direction and opens facing away from the setting direction. A key way 6*a* of the guide ring 5 extends, into the rotary guide groove 10, into the open space of the guide ring 5, such that the guide ring 5 cannot rotate relative to the piston guide 3. An initial guidance element 14 projects from the opposing surface 19 away from the setting direction. The guidance element is a contact pin with which a firing pin 15 of the firing device 2 is displaceable, into a ready-to-fire position, against the force of a spring 17.

When a cartridge is being fired, the entire firing device 2 is displaceable against the force of at least one spring (not shown) opposite the setting direction. As illustrated in FIG. 3, the firing pin 15 of the firing device 2 cooperates with a carrier or driver 16, which cooperates, in a pressure process of the setting tool, with the first guidance element 14—the contact pin. A guide channel 18 is provided at a setting-side stop surface 20 of the firing device 2, for guiding a strip-shaped cartridge magazine (not shown).

A central through hole of the housing 1 widens stepwise, in the setting direction. Accordingly, the housing 1 comprises at least two cylindrical sections with different diameters. An initial section with a smaller diameter communicates opposite the setting direction with a second section with a larger diameter. The firing device is disposed in the area of the initial section. The diameter of the device is proportional to the diameter of the initial section. The piston guide 3 is arranged in the second section, wherein the largest diameter of the piston guide 3 is proportional to the diameter of the second section.

An annular surface, facing in the setting direction, is arranged in the zone of increase in diameter, of the stepwise expansion, of the through passage of the housing 1. A centering sleeve 7 is arranged upon the annular surface, on the side facing away from the setting direction. The centering sleeve 7 opens on the side facing in the setting direction. The centering sleeve 7 is axially fixed in the receiving space 8. An eccentrically expanded part of the centering sleeve 7 provides the rotational resistant fixation of the centering sleeve 7, in the receiving space 8, and the part projects into a corresponding radial widened area 12 of the receiving space 8. The eccentrically widened part of the centering sleeve 7 forms on the inner wall a guide groove 21 extending parallel to the setting direction. The radial measured depth of the guide groove 21 and the extension of the guide groove 21 peripherally correspond to the matched dimensions of the centering lug 6 to the guide groove.

In the unassembled setting tool, illustrated in FIG. 1, the distance Al between a setting-side opening, of the guide groove 21, and the stop surface 20, of the firing device 2 facing in the setting direction, is greater than a maximum distance A2 between the centering lug 6 and the free end facing away from the setting direction of an initial guidance element 14. The distance A1 is, also greater than the sum of the distance A3 between the centering lug 6 and the opposing surface 19 of the piston guide 3 and the distance A4 between the stop surface 20 of the firing device 2 and the setting-side free end of a second guidance element 22.

At assembly, upon installation of the piston guide 3 into the housing 1, these distances, initially provide for a radial centering of the piston guide 3, in the receiving space 8 of the housing 1. Subsequently, these distances permit the centering lug 6, of the centering ring 5, to be situated at the setting-end frontal side of the centering sleeve 7, when the centering lug 6 and the guide groove 21 of the centering sleeve 7 are not in alignment. A corresponding arrangement of the centering lug 6 relative to the guide groove 21 results when the piston guide 3 is turned relative to the firing device 2. The piston guide 3 can be further shifted in the direction of the firing device 2, upon the appropriate arrangement of the centering lug 6 and the guide groove 21. Then, the guidance elements 14, 22 projecting from at least one of the piston guide 3 and the firing device 2 dip into corresponding receiving spaces 23 on at least one of the piston guide 3 and the firing device 2.

What is claimed is:

1. A setting tool comprising a housing (1), a firing device (2) arranged inside the housing (1), a piston guide (3) axially displaceable in the housing (1) with a cartridge magazine (9) and an axially displaceable driving piston (4), and at least one guidance element (14) cooperating with the firing device (2), wherein centering means act between the piston guide (3) and the housing (1), by means of said centering means, guidance elements (14, 22) are arranged on the piston guide (3) and the firing device (2) and extend essentially parallel to the setting direction and are coaxially disposable on the piston guide (3) and the firing device (2) relative to corresponding receiving openings (23) on the piston guide (3) and the firing device (2).

2. The setting device of claim 1, wherein the centering means comprise at least one centering lug (6) and at least one guide groove (21), wherein the at least one centering lug (6) is arranged on one of the piston guide (3) and the housing (1) and the at least one guide groove (21) is arranged on one of the piston guide (3) and the housing (1).

3. The setting tool of claim 2, wherein the setting tool, in a disassembled condition, further includes a space (A1), between a setting-side opening, of the guide groove (21), and a stop surface (2), of the firing device (2), facing in the setting direction, the space (A1) being greater than a maximum distance (A2) between the centering lug (6) and the free end of an initial guidance element (14) facing away from the setting direction greater than the sum of the distance (A3) between the centering lug (6) and the opposing surface (19) of the piston guide (3) and the distance (A4) between the stop surface (20) of the firing device (2) and the setting-side free end of a second guidance element (22).

4. The setting tool of claim 3, wherein the space (A1) is further greater than the sum of the distance (A3) between the centering lug (6) and the opposing surface (19) of the piston guide (3) and the distance (A4) between the stop surface (20) of the firing device (2) and the setting-side free end of a second guidance element (22).

5. The setting tool of claim 2, wherein at least one part of the guide groove (21) is a centering sleeve (7) opening in the setting direction and fixed in a receiving orifice (8) of the housing (1).

6. The setting tool of claim 2, wherein the setting tool, in a disassembled condition, further includes a space (A1), between a setting-side opening, of the guide groove (21), and a stop surface (2), of the firing device (2), facing in the setting direction, the space (A1) being greater than the sum of the distance (A3) between the centering lug (6) and the opposing surface (19) of the piston guide (3) and the distance (A4) between the stop surface (20) of the firing device (2) and the setting-side free end of a second guidance element (22).

7. The setting tool of claim 1, wherein the at least one centering lug (6) is part of a centering ring that encircles the piston guide (3) and is rotationally resistantly connected to the piston guide (3).

8. The setting tool of claim 7, wherein the centering ring (5) is displaceable, in the setting direction, against the force of a spring element (11).

9. The setting tool of claim 7, wherein a rotational guide of the centering ring (5) projects into the open space of the centering ring (5), the centering ring (5) projecting into a rotational guide groove (10), on the piston guide (3), and extending parallel to the setting direction.

10. The setting tool of claim 1, wherein the guidance element (14) projecting from the piston guide (3) is a contact pin cooperating with the firing device (2).

11. The setting tool of claim 1, wherein the guidance element (22) projecting from the firing device (2) is an axially displaceable regulation pin of a power regulation device.

* * * * *